United States Patent [19]

Dissinger

[11] Patent Number: 4,900,015

[45] Date of Patent: Feb. 13, 1990

[54] EXERCISE DEVICE

[76] Inventor: Thomas E. Dissinger, 104 Roberts La. - 300, Alexandria, Va. 22314

[21] Appl. No.: 169,600

[22] Filed: Mar. 17, 1988

[51] Int. Cl.[4] ..... A63B 21/00

[52] U.S. Cl. ..... 272/116; 272/120; 272/135; 272/137

[58] Field of Search ..... 272/144, 135, 137, 138, 272/134, 126, 93, 72, 116, 117, DIG. 4, 143

[56] References Cited

U.S. PATENT DOCUMENTS

| | | | |
|---|---|---|---|
| 3,572,701 | 3/1971 | Agamian | 272/117 X |
| 3,759,512 | 9/1973 | Yount et al. | 272/134 |
| 4,319,747 | 3/1982 | Rogers | 272/117 |
| 4,610,448 | 9/1986 | Hill | 272/143 X |
| 4,611,807 | 9/1986 | Castillo | 272/DIG. 4 X |
| 4,720,100 | 1/1988 | DuBuy | 272/117 X |
| 4,757,992 | 7/1988 | Heitsch et al. | 272/134 |
| 4,765,612 | 8/1988 | Henry, Jr. | 272/117 X |

*Primary Examiner*—Richard J. Apley
*Assistant Examiner*—Howard Flaxman
*Attorney, Agent, or Firm*—William F. Frank

[57] ABSTRACT

The invention is used to perform push-ups and seated dips. The invention is composed of two opposing cylindrical handle assemblies, each consisting of a vertical and a horizontal portion, that rotate about a horizontal axis supported by the base. The base supports the handle assemblies, maintains the distance between the handle assemblies, and provides stability to the apparatus. The device proposed herein is superior to the prior art in that a horizontal force needs to be exerted in addition to the vertical force, while using the device to perform push-ups and dips.

9 Claims, 6 Drawing Sheets

EXERCISE DEVICE

FIELD OF INVENTION

The present invention is in the general field of exercise devices for the improvement of the muscular structure of the body. Specifically, the invention is restricted to the development of the muscles of the chest, arms and shoulders.

BACKGROUND OF THE INVENTION

There are various exercises which are performed to improve and/or increase the muscular strength or tone of the upper body. The simplistic exercises are those in which the upper torso is twisted and turned, the arms are raised and lowered in a rhythmic pattern, the muscles are tensed and moved against an imaginary counterforce, i.e. isometric exercise, the body is spaced from a wall and the exercisor then stresses the arm and chest muscles by forcefully leaning into and cyclically pushing the body toward and away from the wall. More stressful exercises are those in which the body is generally placed parallel to a horizontal surface in an extended position and while maintaining the extended position the body is pivotally moved about the feet by the use of the arms. There are two exercise positions which can be employed to conduct such muscular stressing. One is known as push-ups and the other is known as dips.

Push-ups and seated dips (hereinafter referred to as "dips") are two exercises that develop primarily the chest muscles with a lesser emphasis on the arms and shoulders. Push-ups are performed by the user laying face-down on a flat horizontal surface and raising and lowering his upper body by vertically extending and contracting his arms. "Dips" are performed by the user maintaining a seated position with his feet on the floor or in a more stressed position on a raised surface, placing his hands on separate supports, and raising and lowering his body by vertically extending and contracting his arms.

Devices for performing pushups can be seen in U.S. Pat. Nos. 4,610,448; 4,358,106; 4,351,525 and 2,666,640 as examples. These devices raise the portion of the hands of the exercisor above the floor, thus allowing the user to lower the upper portion of his body below the normal level of the shoulders when performing push-ups. Likewise, when performing dips, the devices permit the lower trunk of the body to fall below the upper level of the devices between the devices. When performing either of these exercises, muscles are required to only counter a vertical force which is the weight of the body.

SUMMARY OF THE PRESENT INVENTION

The invention is used to perform push-ups and seated dips. The invention is composed of two opposing cylindrical handle assemblies, each consisting of a vertical and a horizontal portion that rotate about a horizontal axis supported by the base. The base supports the handle assemblies, maintains the distance between the handle assemblies, and provides stability to the apparatus.

BRIEF DESCRIPTION OF THE DRAWINGS

The present invention can be seen in an illustrative embodiment in the accompanying drawings as well as the method of use of the invention.

DETAILED DESCRIPTION OF THE INVENTION

Figure 1:
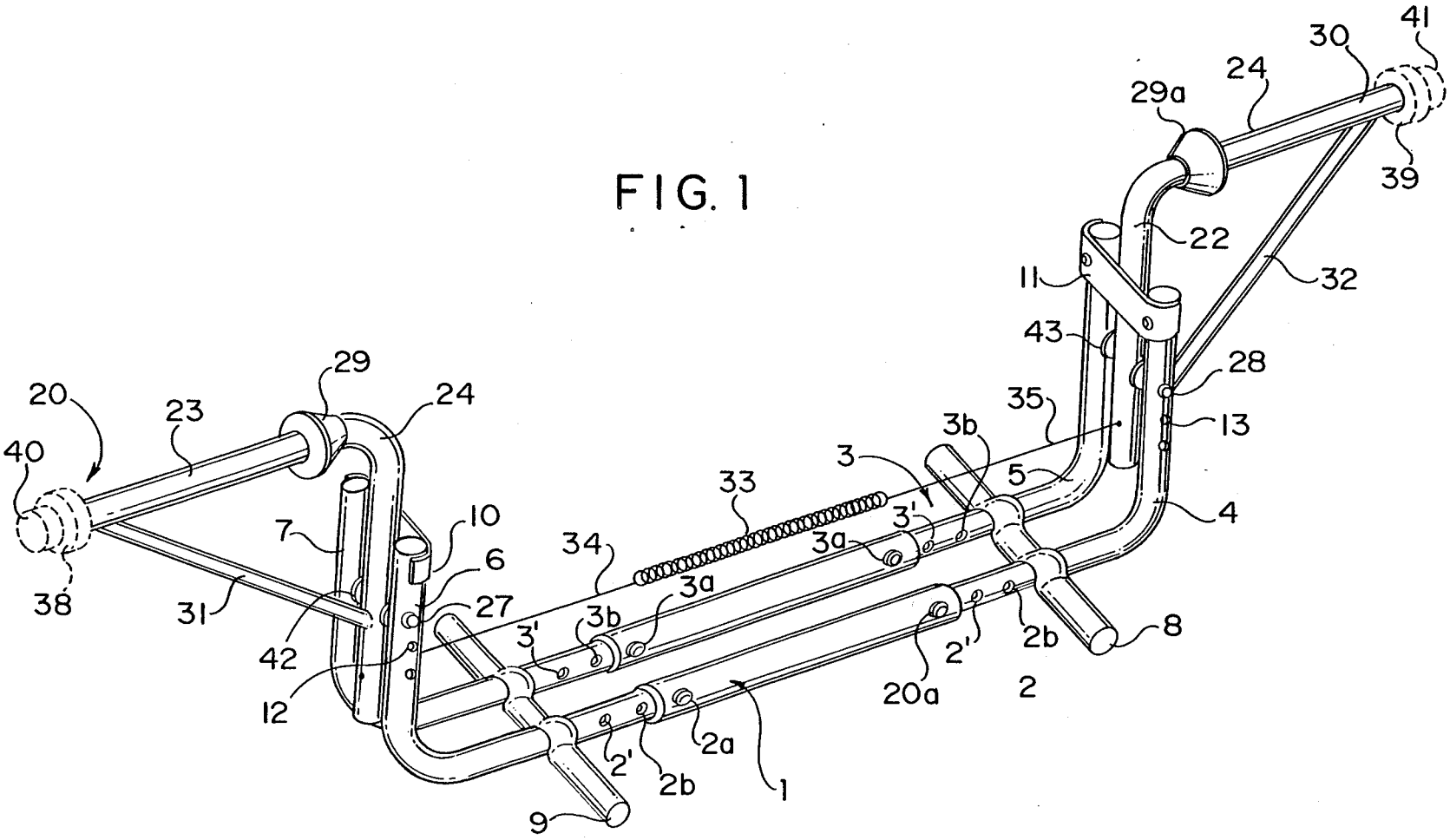
FIG. 1 is a perspective view of the present invention in a preferred embodiment.

Referring now to FIG. 1, the present invention basically comprises a support base assembly 1 and a pair of spaced apart pivotally attached handle assemblies 20 and 30. The base assembly 1 comprises a pair of spaced apart horizontal members 2 and 3 with upstanding end members 4, 5, 6 and 7. End members are maintained in the vertical positions shown by at least two lateral support members 8 and 9 which are rigidly secured to members 2 and 3 by conventional means, i.e. screws or welding. Additional support for end members 4, 5, 6 and 7 is provided by brackets 10 and 11 which are secured to their respective end members by conventional means and also prevent the handle assemblies 20 and 30 from moving inwardly. The end members 4, 5, 6 and 7 are each provided with a plurality of matching through passing holes 12 and 13. The purpose of the openings 12 and 13 is to permit vertical adjustable positioning of the hand assemblies 20 and 30 to vary the distance of the arm movement required to maintain zero stability of the hand assemblies in the use of the present invention.

The horizontal distance between end members 4 and 5 and 6 and 7 can be varied to accommodate the shoulder and hip widths of the user. This is accomplished by the fact that horizontal members 2 and 3 are each in two equal sections which are joined together by sleeves 2' and 3'. Each sleeve has a hole **2*a* and 3*a* in each end. The interior ends of each section of members 2 and 3 have a plurality of spaced holes 2*b* and 3*b* which can be aligned as desired by holes 2*a* and 3*a* in the sleeves. Locking pins 2*c* and 3*c* can be inserted into the aligned holes. Alternatively, holes 2*b* and 3*b* may be tapped on bolts 2*e* and 3*f* and can be passed through holes 2*a* and 3*a*** and threaded into the tapped holes.

Each hand assembly 20 and 30 is comprised of a vertical element 21 and 22 and a horizontal element 23 and 24 extending outwardly from the numbers 4, 5, 6, and 7 from the upper ends of elements 21 and 22, 23 and 24. Each vertical element 21 and 22 has an opening, not seen, through which will match one of the respective holes 12 and 13 in respective end members 4 and 5 and 6 and 7 to provide pivotal movement relative to their respective end members by means of pins 27 and 28. Interposed between the hand assemblies and the upstanding end members 4 and 5 and 6 and 7 are washers 42 and 43 respectively. Adjustably positioned on each of the inner portions of elements 23 and 24 are hand stops 29 and **29*a*. The positioning of stops 29 and 29*a* outwardly, along elements 23 and 24 increases the movement to be overcome by the user to restore the hand assemblies 20 and 30 to a position wherein there is no outwardly rotational movement by the assemblies 20 and 30. Because of the downward force directed on elements 23 and 24 by the user's weight, to prevent distortion of the angular relationship between the respective elements 21 and 22 and 23 and 24, there is provided for each assembly angular braces 31 and 32**.

Interconnecting the lower ends of hand assemblies 20 and 30 is a resilient member 33 which is connected to the respective ends of the hand assemblies by elements 34 and 35. The purpose of member 33 is to provide a force which can be adjusted tensionally to move the vertical elements 21 and 22 of the hand assemblies 20 and 30 from a static vertical position to an outwardly inclined angular position. Any outwardly positioning of the vertical elements 21 and 22 from the vertical static position inherently increases the horizontal resisting force required to move elements 21 and 22 to a static position as will be described subsequently. The means required to adjust the tension imparted by member 33 are numerous and of conventional and well-known knowledge.

Resilient member 33 may be a conventional spring or a length of an elastic material, either having the character of memory. Elements 34 and 35 may be cables or rods or a combination. Whatever the choice, it is preferable that at least one of the ends to be attached to the lower ends of elements 21 and 22 of the hand assemblies 20 and 30 be threaded so as to receive a nut which not only retains element 34 or 35 in the lower end of element 21 or 22 but can be rotated to increase the tension on resilient member 33.

Depending upon the material from which the hand assemblies 20 and 30 are made, it may be necessary to install angle braces 31 and 32 between the lower ends of elements 21 and 22 and horizontal elements 23 and 24 respectively, as described above. It is within the scope of the present invention to add weights 38 and 39 shown in phantom lines to the outer ends of the hand assemblies. This will increase the force required to maintain the hand assemblies in a vertical position. To minimize the weights slipping off the ends of elements 23 and 24, the end of such element may have an elongated plate 40 shown in phantom attached to element 23 or a removable cap 41 shown in phantom on element 22.

Figures 2, 3:
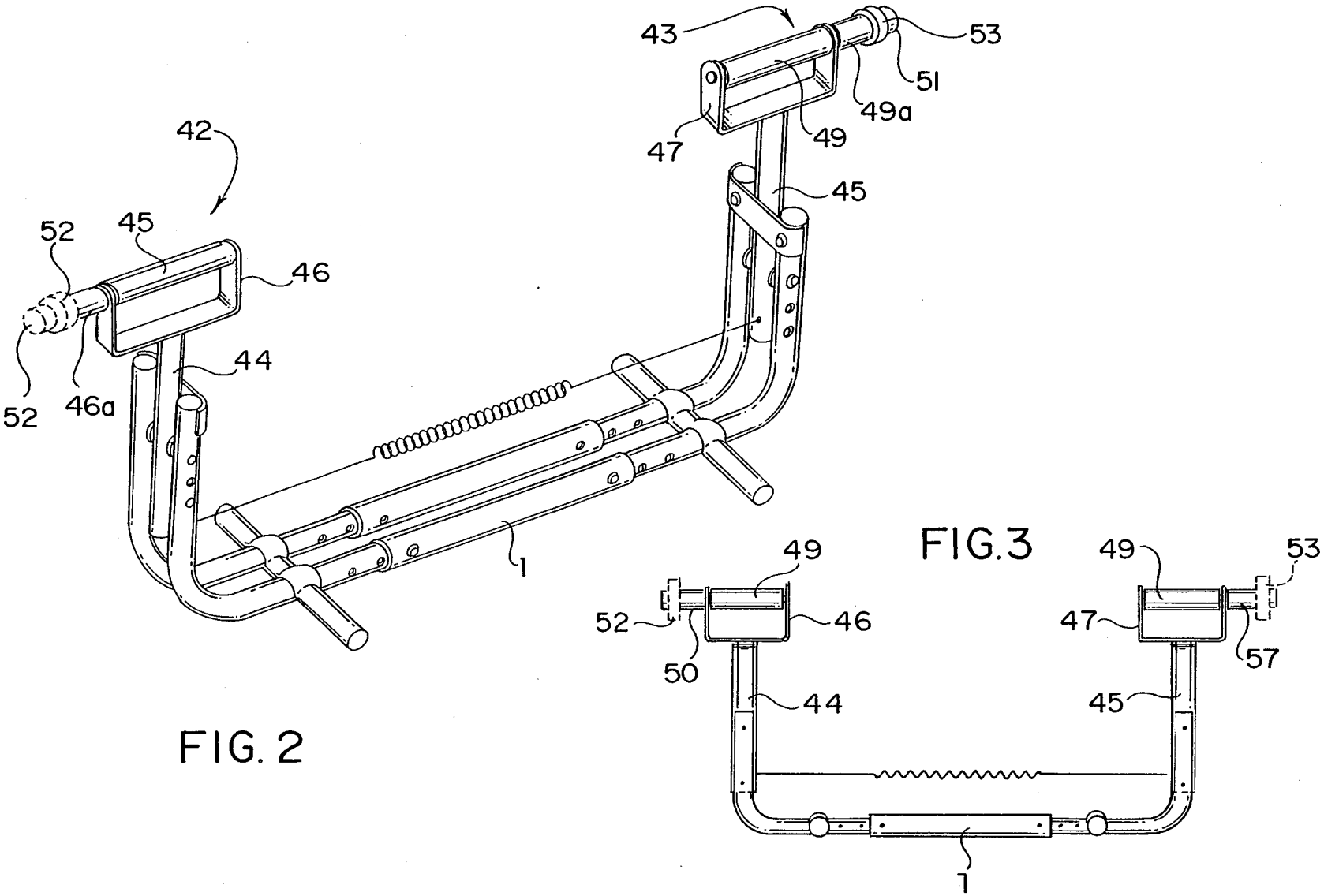
FIG. 2 is a perspective view of a second embodiment of the present invention.
FIG. 3 is an elevation view of the embodiment seen in FIG. 2.

With reference to the first alternate embodiment seen in FIGS. 2 and 3, this embodiment has the same base assembly as seen in FIG. 1 which is the advanced embodiment of the present invention. This embodiment includes pivotal hand assemblies 42 and 43. Each hand assembly comprises a vertical member 44 and 45 which may have a plurality of holes **44*a* and 45*a*, or a single hole (not visible). Affixed to the upper ends of members 44 and 45 are U-shaped brackets 46 and 47. Secured between the upper ends of these brackets are hand holds 48 and 49. Hand holds 48 and 49 may have outward extensions 50 and 51 shown in phantom to receive weights 52 and 53 shown in phantom. Hand assemblies 42 and 43 are pivotally and vertically adjustably mounted witin upstanding end members 4, 5, 6 and 7. The extensions 50 and 51 may have the outward end faces treated in the manner described previously relative to the hand assemblies 20 in FIG. 1**.

Figure 5:
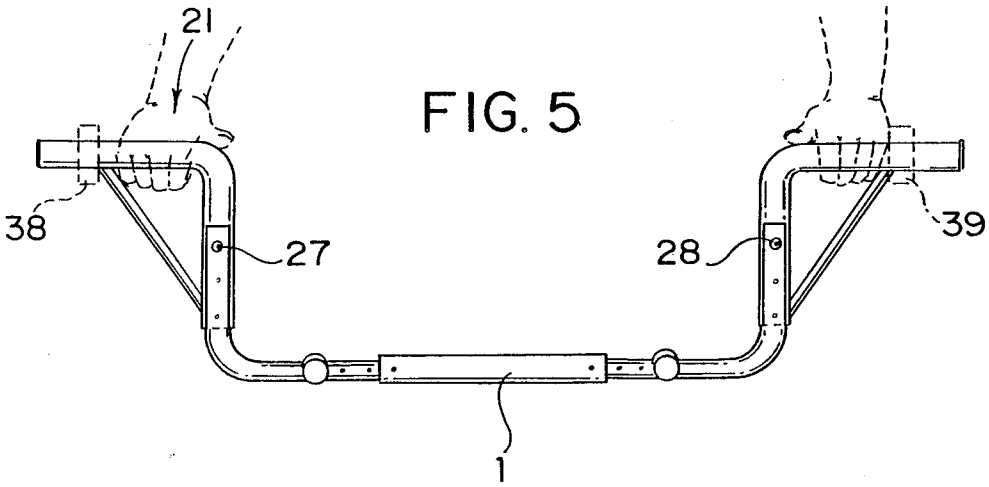
FIG. 5 is an elevation view of the embodiment seen in FIG. 4.
Figure 4:
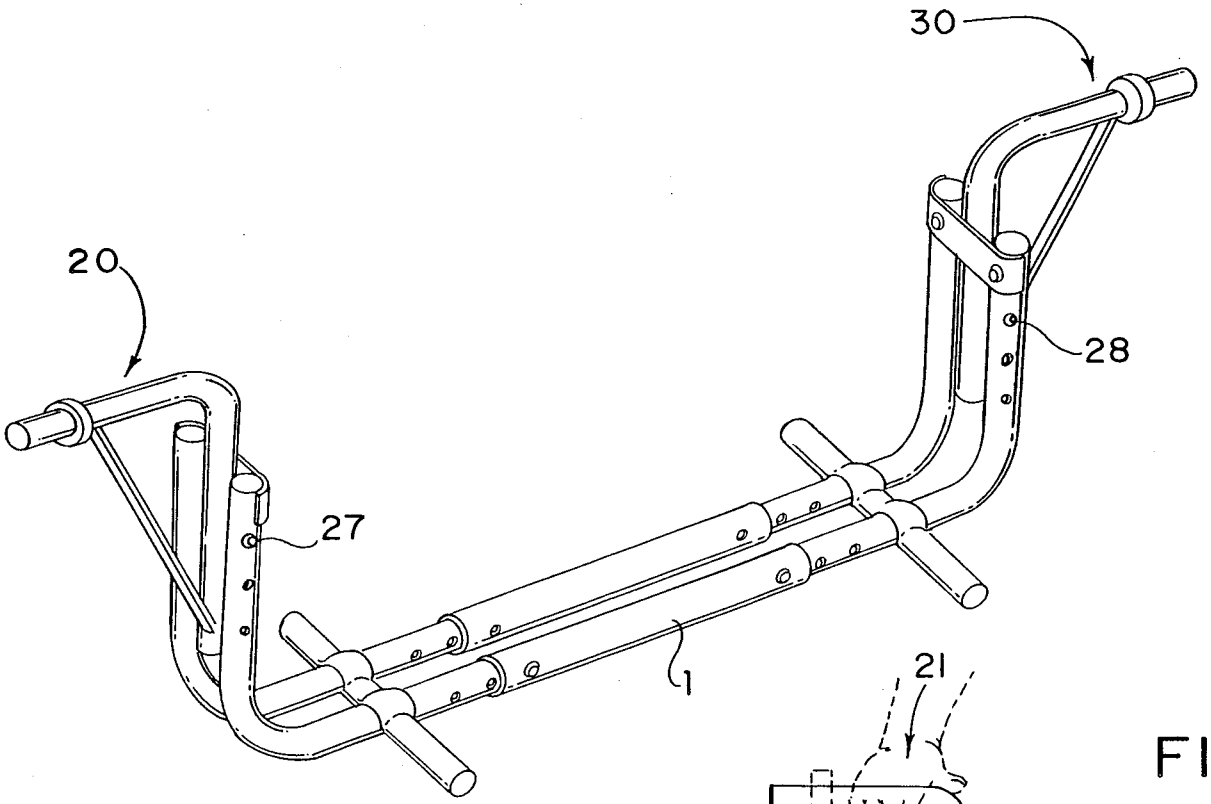
FIG. 4 is a perspective view of a third embodiment of the present invention.

The embodiment seen in FIGS. 4 and 5 is substantially identical to that seen in FIG. 1 with the exception that the rsilient member 33 and elements 34 and 35 and hand stops 29 and **29*a* are not present. Additionally, the vertical elements 21 and 22 of the hand assemblies 20 and 30 may have only a single hole for pivotally moving the hand assemblies between the upstanding end members 4 and 5 and 6 and 7. In this embodiment the horizontal elements 23 and 24 may have weights 38 and 39 as described with reference to FIG. 1**.

Figures 6, 7:
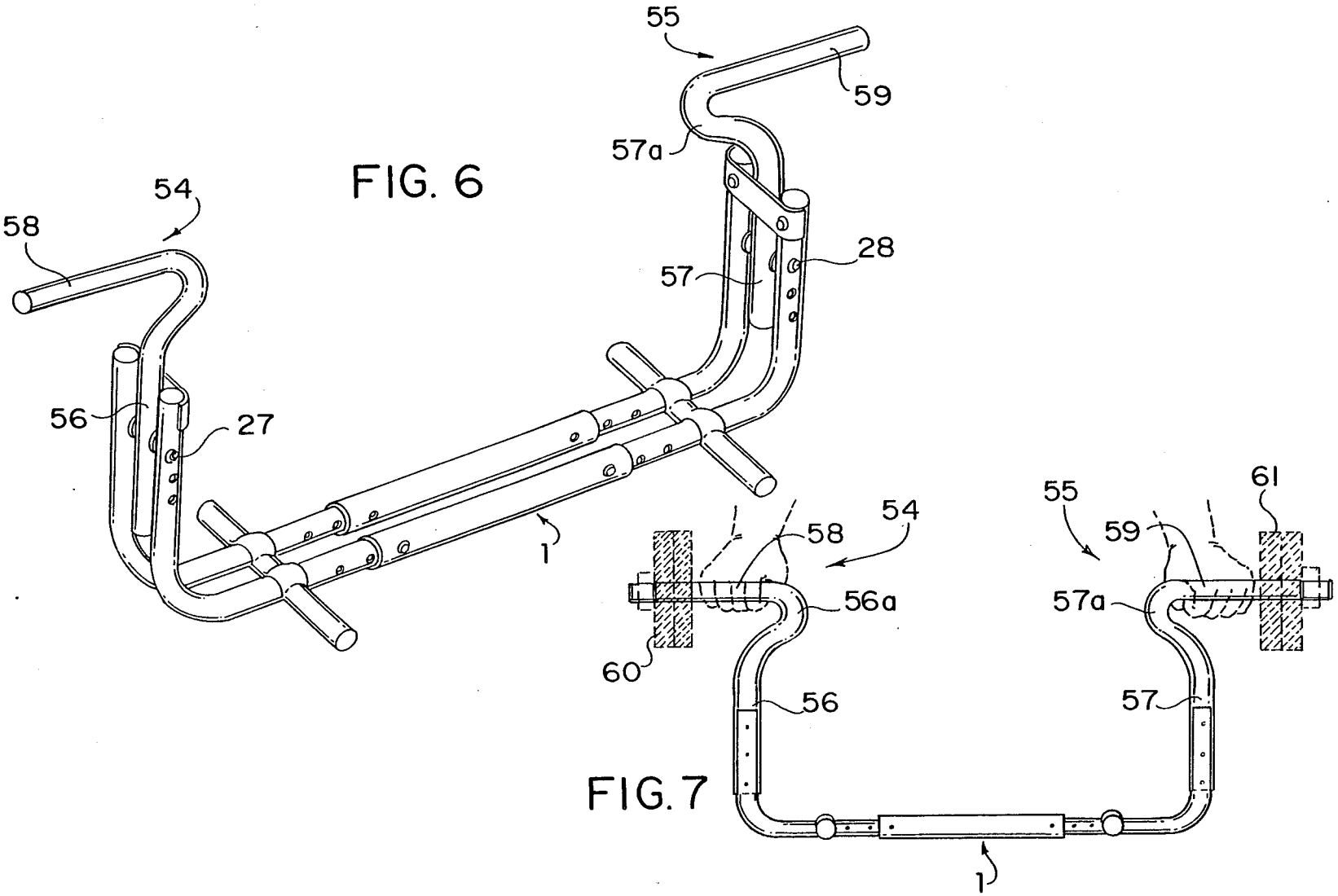
FIG. 6 is a perspective view of a fourth embodiment of the present invention.
FIG. 7 is an elevation view of the embodiment seen in FIG. 6.

The embodiment shown in FIGS. 6 and 7 has the same base assembly as seen in FIGS. 4 and 5. The hand assemblies 54 and 55 are pivotally mounted between upstanding end members 4 and 5 and 6 and 7 by means of a single hole (not seen), or may have a plurality of holes as in FIG. 1, in each vertical element 56 and 57. The vertical elements terminate at the upper ends in arcutate segments **56*a* and 57*a* to each of which is secured a horizontal element 58 and 59. Elements 58 and 59 are of sufficient length that the user's hands may be moved from a position substantially in alignment with vertical axis of the elements 56 and 57 outwardly along each element 58 and 59. The length of elements 58 and 59 is such as will permit the placing of weights 60 and 61** on the ends of the elements with minimal interference with the movement of the user's hands as just described.

Figure 8:
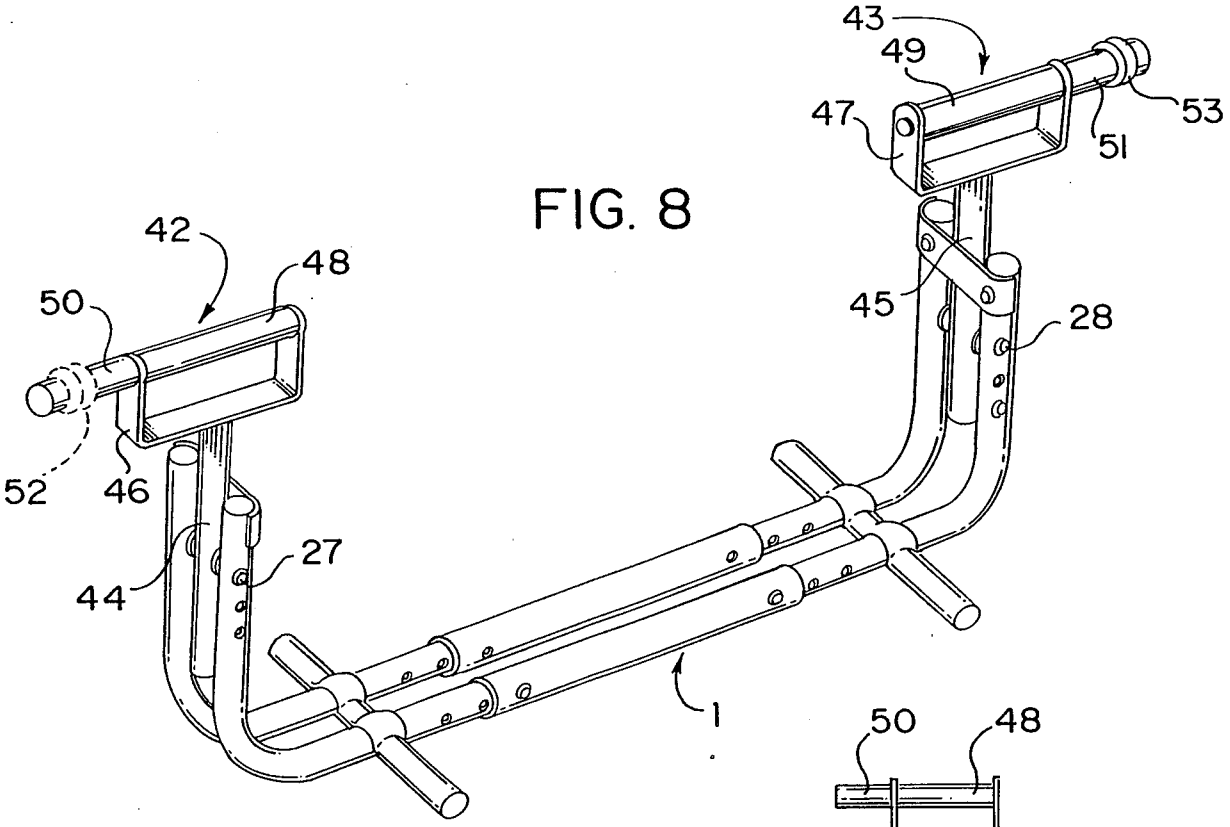
FIG. 8 is a perspective view of a fifth embodiment of the present invention.
Figure 9:
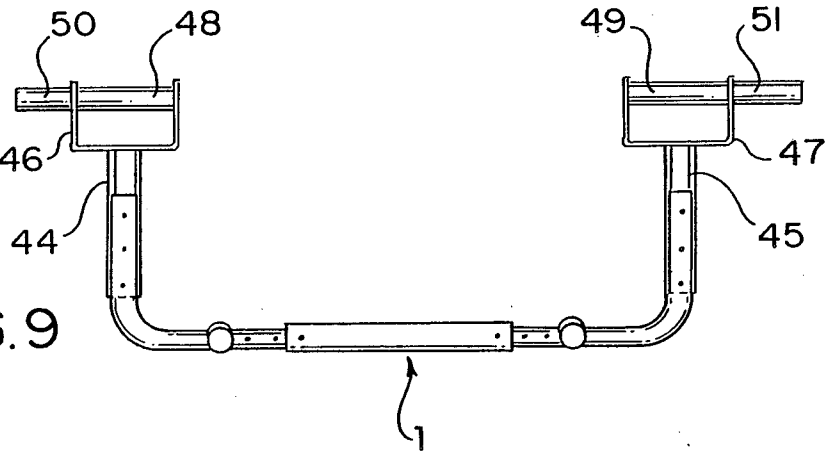
FIG. 9 is an elevation view of the embodiment seen in FIG. 8.

The embodiment shown in FIGS. 8 and 9 is substantially identical to that seen in FIGS. 2 and 3 with the omission of the resilient member 33 and connecting elements 34 and 35. Also the hands holds 48 and 49 include an extension **48*a* and 49*a*** on the outer ends of the hand holds for the purpose of retaining weights as previously described.

The weights which may be used with all the embodiments are not a part of the invention per se. While the employment of weight retaining means has been described in detail with reference to FIG. 1, the weight may be so configured with a center opening as to engage the various horizontal elements of the hand assemblies in such frictional fit as to preclude their sliding off the end of those elements prior to using the invention.

Figure 10:
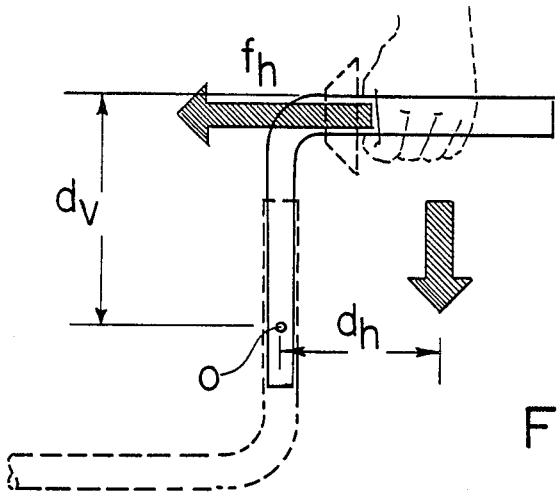
FIG. 10 is a diagram of the forces required to be exerted using the embodiments seen in FIGS. 4 and 6.
Figure 11:
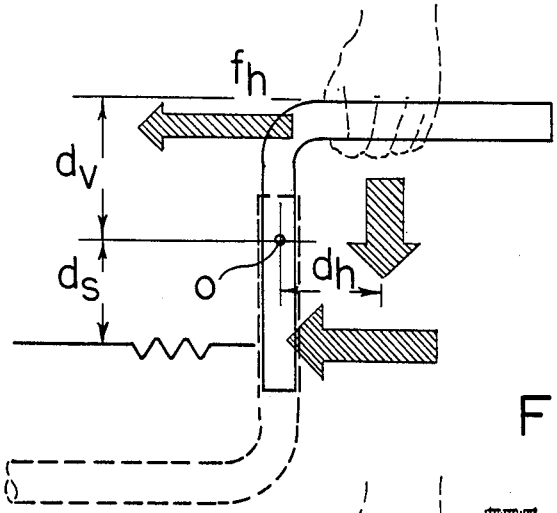
FIG. 11 is a diagram of the forces required to be exerted using the embodiments seen in FIGS. 1, 2 and 3.
Figure 12:
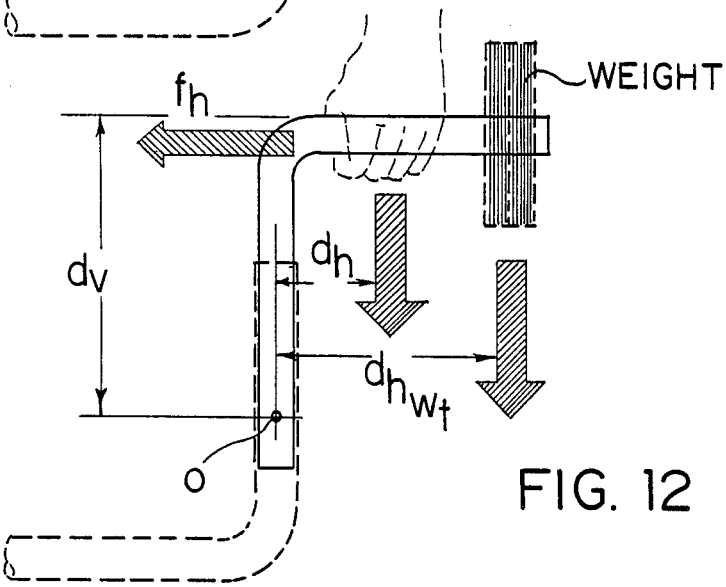
FIG. 12 is a diagram of the forces required to be exerted when using any of the embodiments shown with the addition of weights on the hands.
Figure 13:
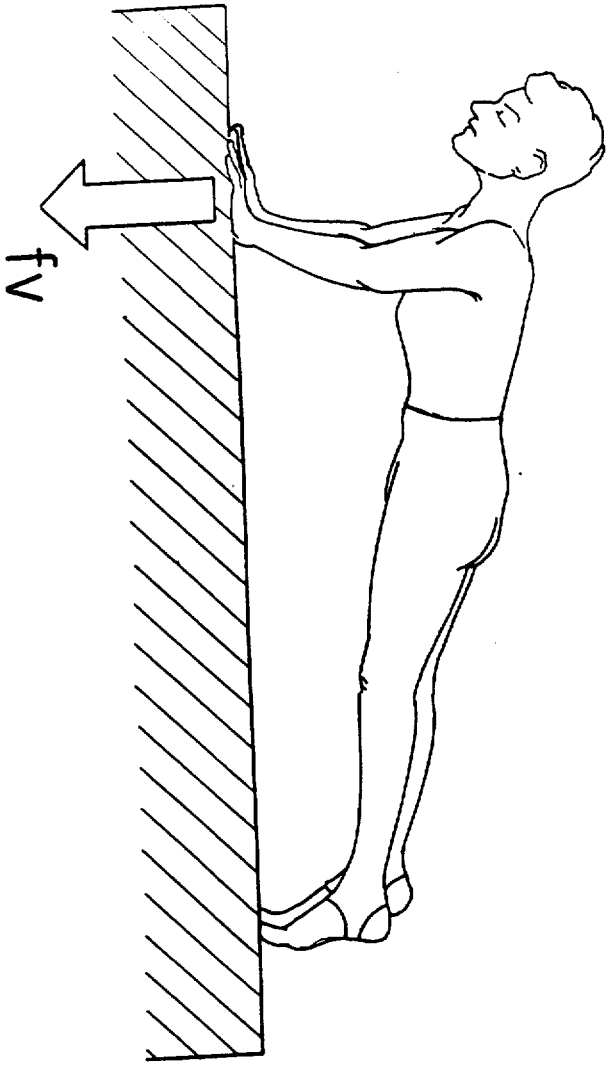
FIG. 13 is a side elevation view of a person in the extended position in performing push-ups in the conventional manner.
Figure 14:
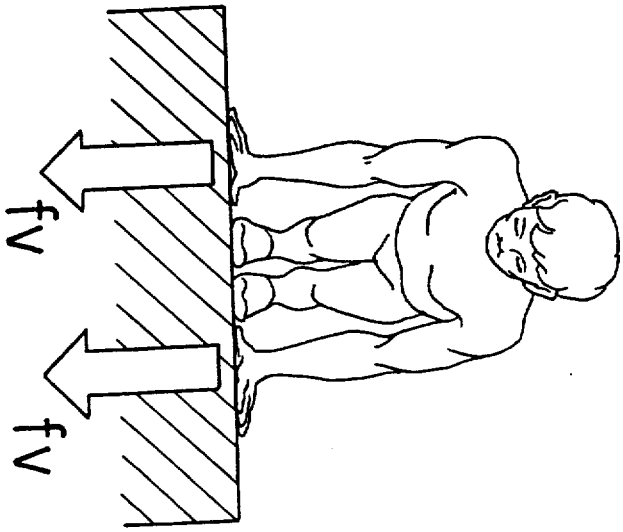
FIG. 14 is a left end elevation view of FIG. 13.
Figure 15:
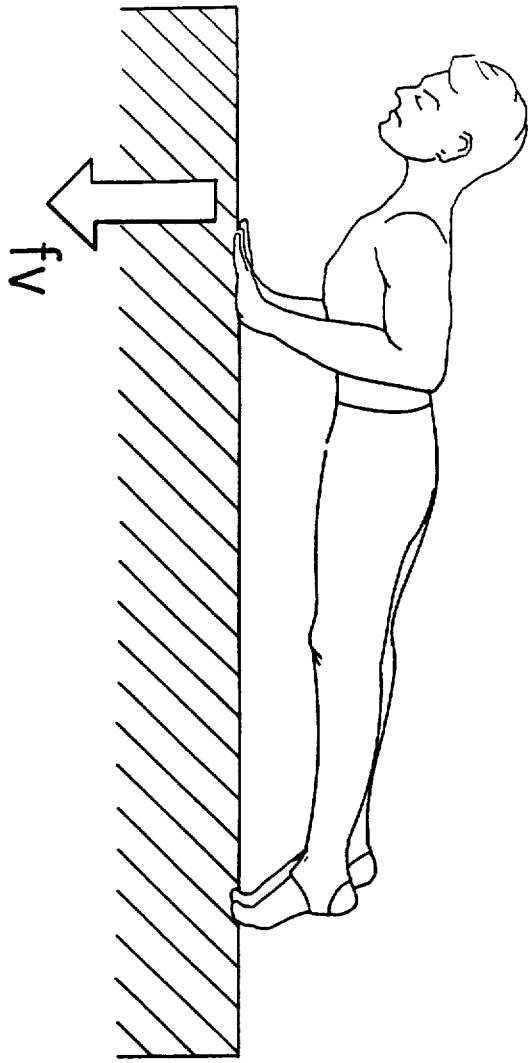
FIG. 15 is a side elevation view of a person in the lowered position in performing push-ups in the conventional manner.
Figure 16:
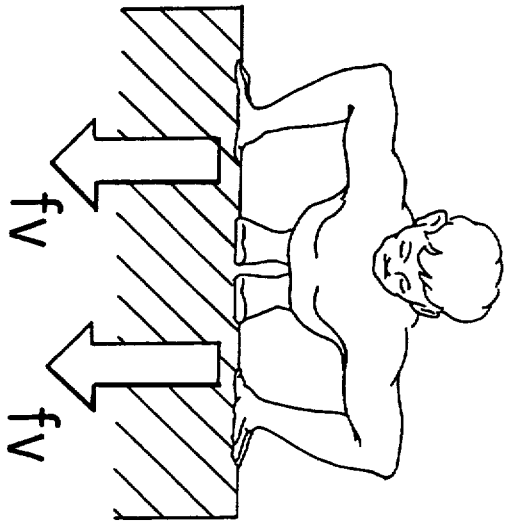
FIG. 16 is a left end elevation view of a person in the lowered position in performing push ups.
Figure 17:
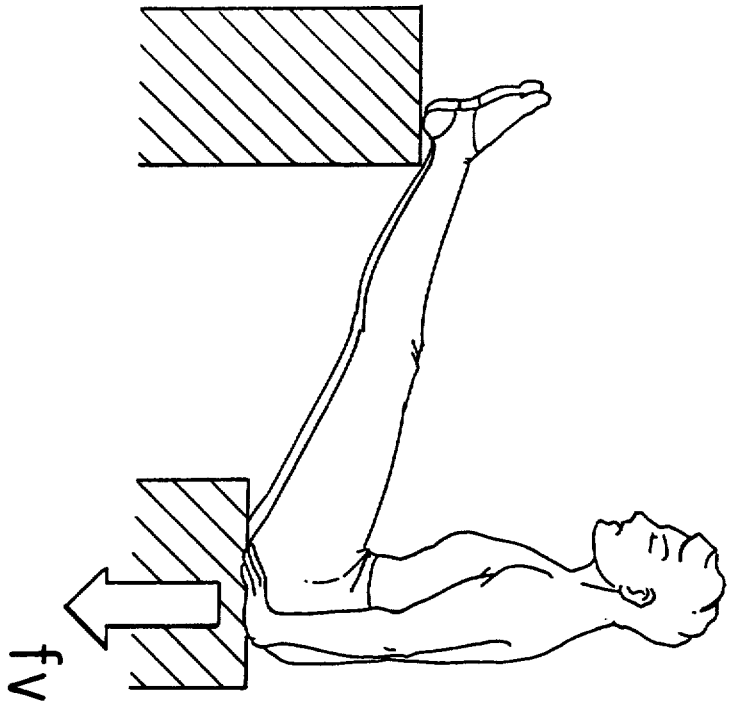
FIG. 17 is a side elevation view of a person performing dips in the extended position.
Figure 18:
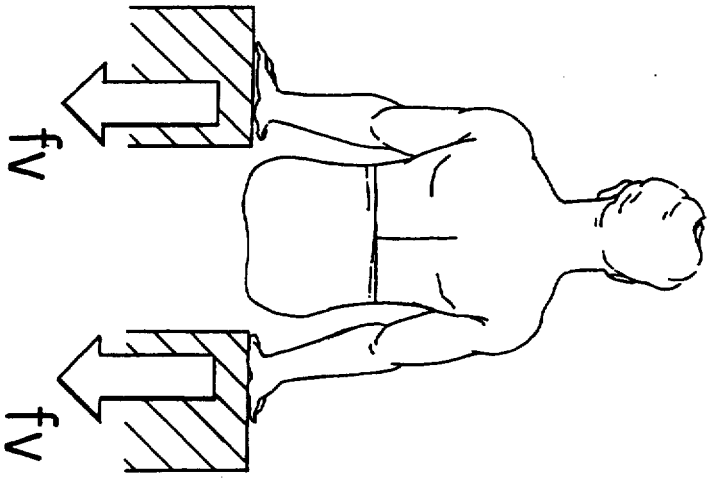
FIG. 18 is a right end elevation view of FIG. 17.
Figure 19:
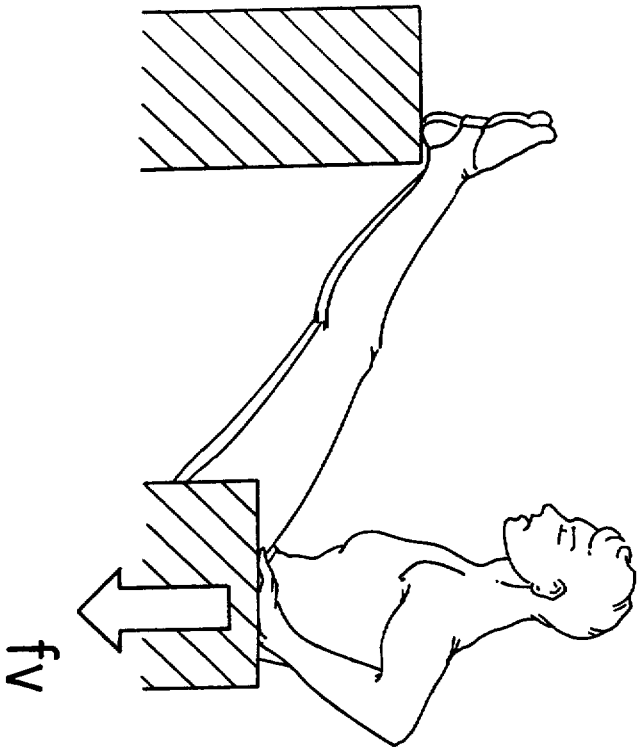
FIG. 19 is a side elevation view of a person in the lowered position in performing dips.
Figure 20:
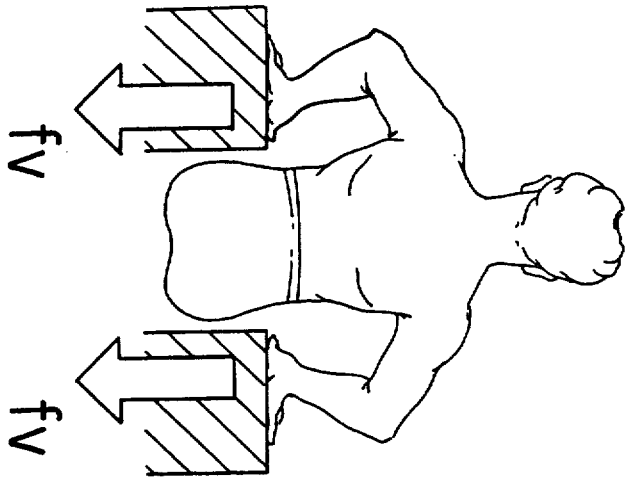
FIG. 20 is a right end elevation view of FIG. 19.
Figure 21:
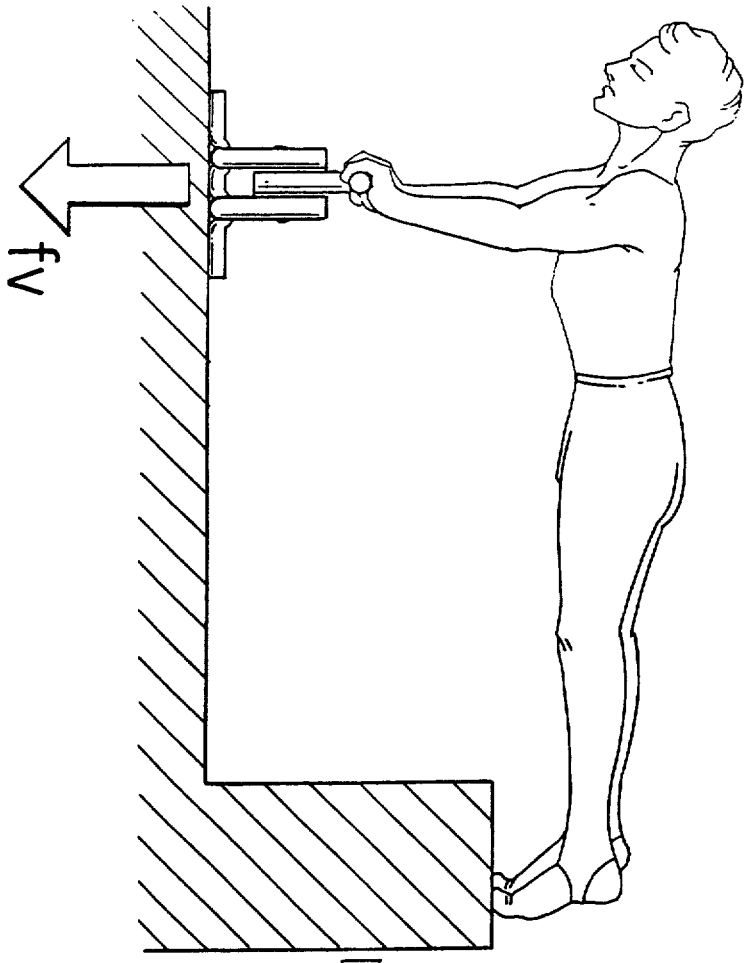
FIG. 21 is a side elevation view of a person in the extended position in performing push-ups with the present invention.
Figure 22:
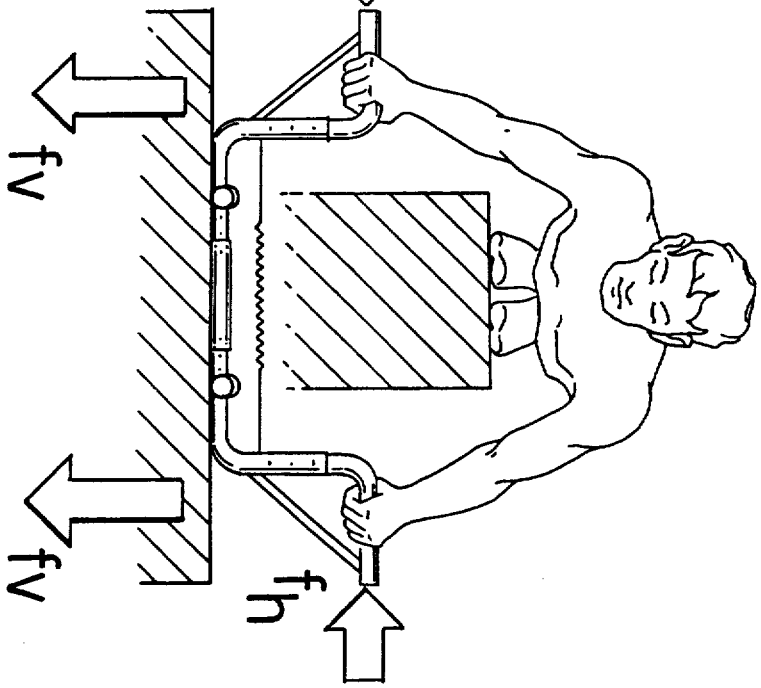
FIG. 22 is a left end elevation view of FIG. 21.
Figure 23:
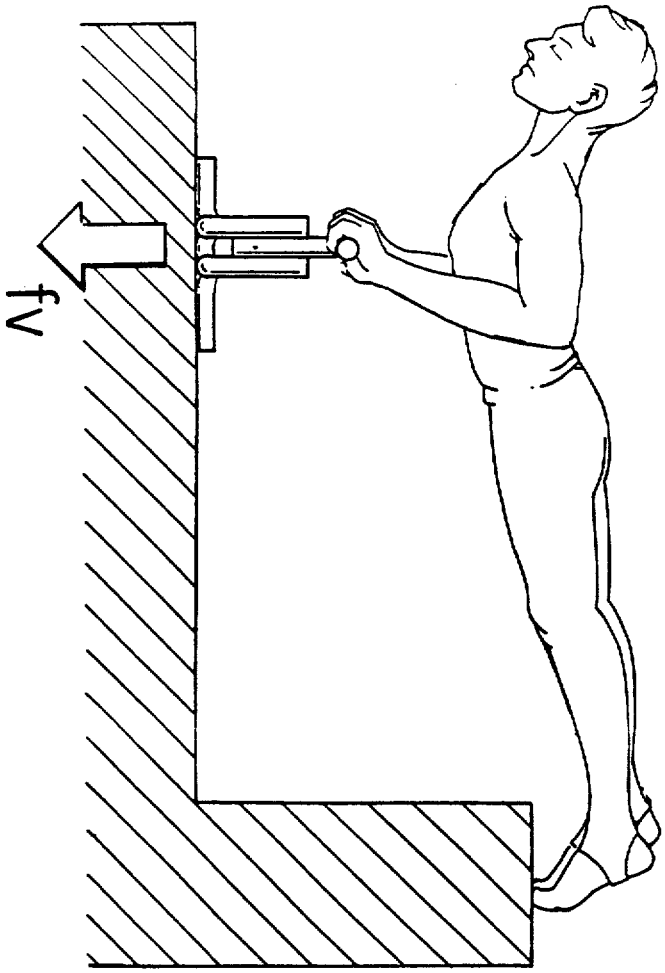
FIG. 23 is a side elevation view of a person in the lowered position performing push-ups with the present invention.
Figure 24:
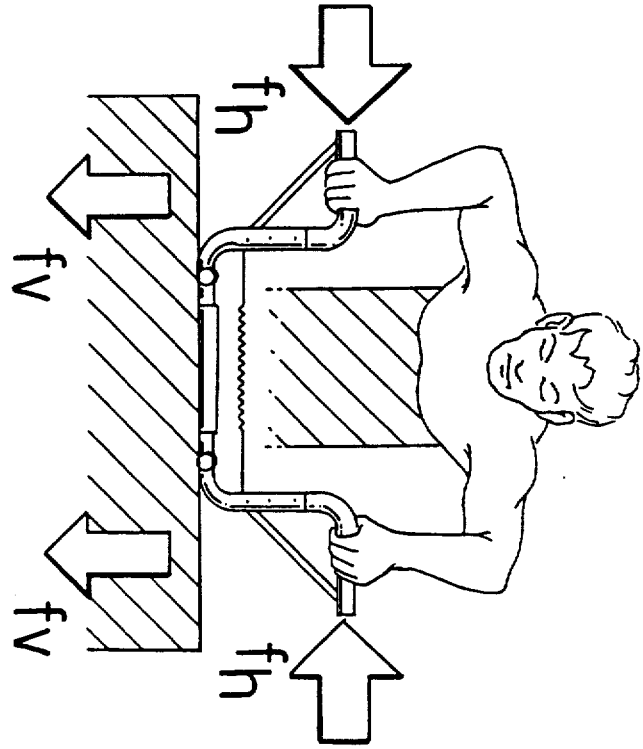
FIG. 24 is a left end elevation view of FIG. 23.
Figure 25:
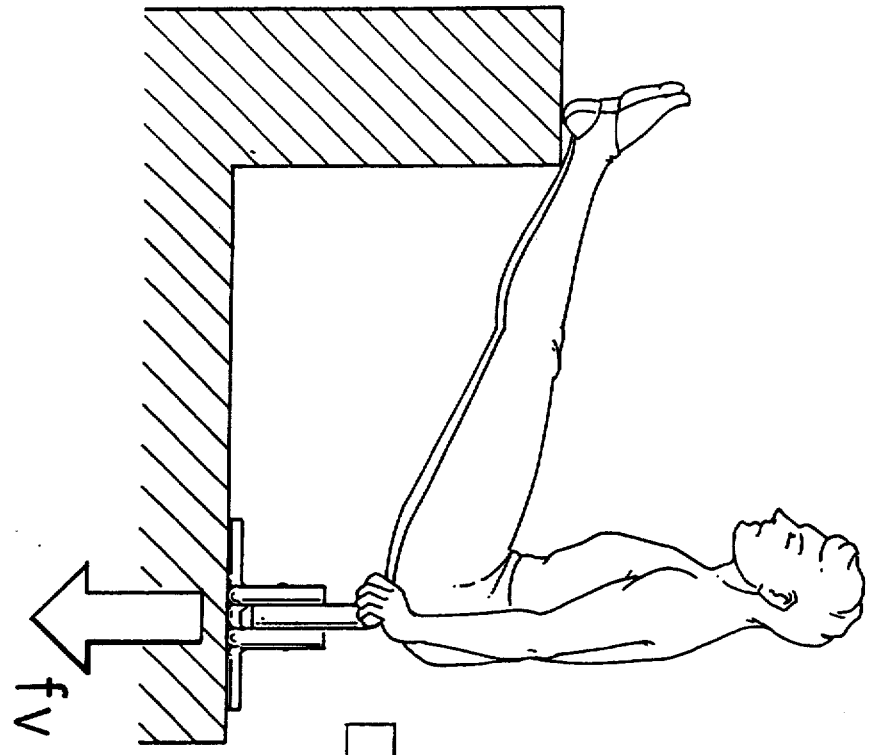
FIG. 25 is a side elevation view of a person in the extnded position performing dips with the present invention.
Figure 26:
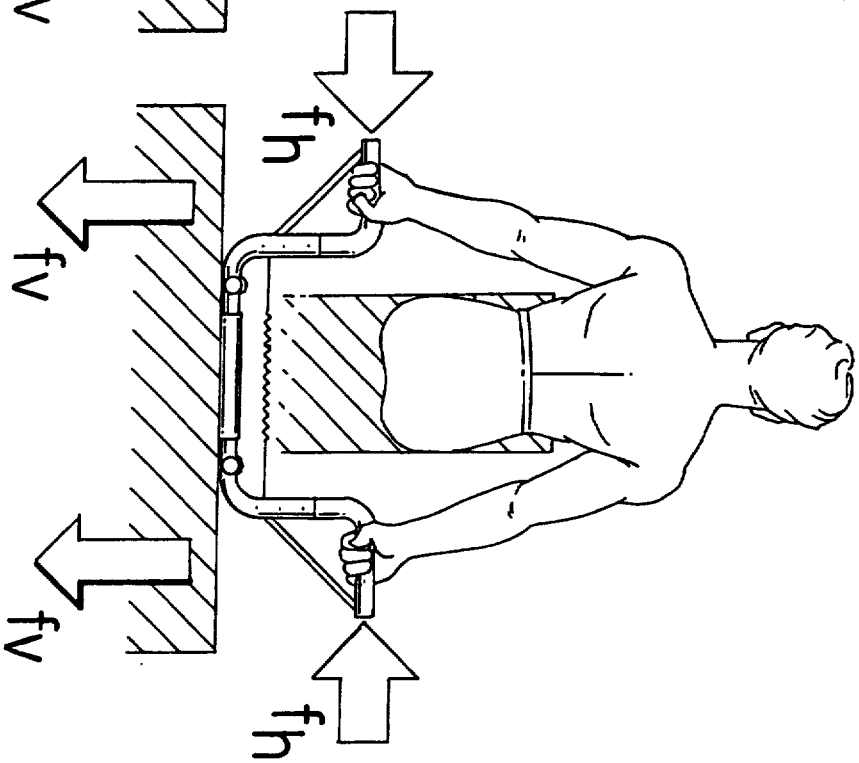
FIG. 26 is a right end elevation view of FIG. 25.
Figure 27:
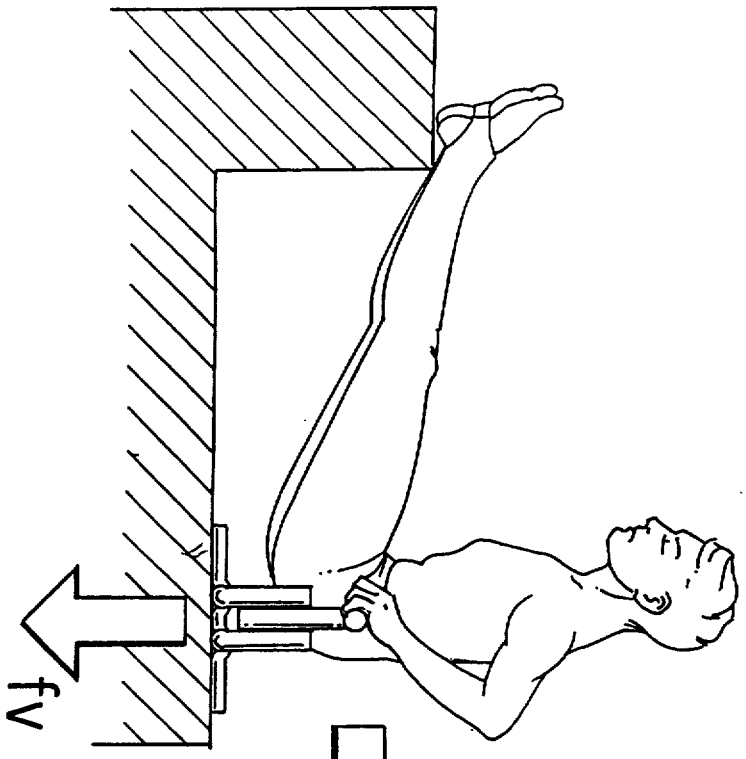
FIG. 27 is a side elevation view of a person in the lowered position in performing dips with the present invention.
Figure 28:
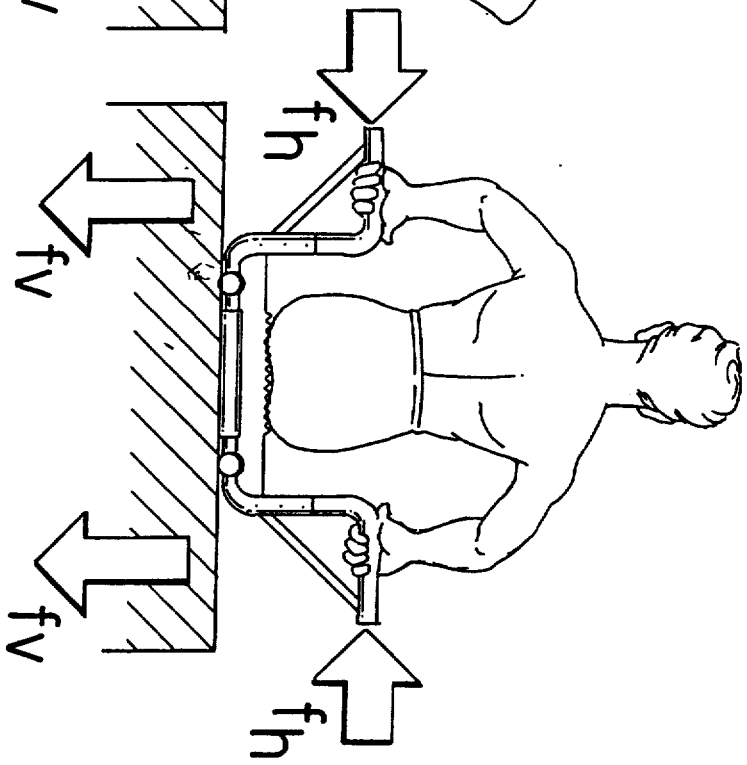
FIG. 28 is a right end elevation view of FIG. 27.

FIGS. 10–12 display graphically and grammatically the efforts that must be exerted by an exercisor using the present invention. The kineseology inherent in the use of the exercises herein depicted is explained in some detail in U.S. Pat. No. 4,610,448. This application is restricted to the physical structure of the invention. The muscular interaction as described in the aforementioned patent is incorporated herein for reasons of increasing the knowledge of the lay reader of this disclosure and any use of the exercises so described. Such incorporation in no way limits or otherwise restricts the disclosure of the physical structure of the present invention.

Referring to FIG. 10, to maintain the handles in equilibrium, that is, the horizontal portion of the handle assembly in a horizontal sleeve, the sum of the moments about the pivot point $(o)_x$ must equal zero; i.e. $\Sigma m_o = 0 = > f_h \times d_v = Wt_{user} \times d_h$. With reference to FIG. 11, again the sum of moments about pivot point (o) must equal zero; i.e. $f_h \times d_v = Wt_{user} \times d_h + f_{resilient\ member} \times d_s$. In FIG. 12, again the sum of the moments about pivot point (o) must equal zero; i.e. $f_h \times d_v = Wt_{user} \times d_{h\ user} + Wt \times d_{hwt}$.

FIGS. 13–20 graphically disclose the energy an exercisor must expect to expend when performing push-ups and dips without any augmenting apparatus or using apparatus as disclosed in U.S. Pat. Nos. 4,610,448, 4,358,106 and 4,351,525.

FIGS. 21–28 depict graphically the muscular energy an exercisor must apply to properly use the present invention. The showings herein when coupled with the showings in FIGS. 10–12 clearly establish that the present invention presents a challenge to its user and a resultant enhancer of muscular development which has heretofore not been available for physical fitness.

The present invention has been presented n a maximized embodiment with alternative embodiments which permit a step-by-step improvement in muscular tone. The physical components may be varied in shape by those of skill in the art but will yet fall within the scope of the appended claims.

What is claimed is:

1. An exercise device for the upper torso comprising a stabilized base assembly with separated upstanding end members and a hand gripping assembly pivotally mounted to each of said upstanding end members, said base assembly comprising a pair of parallel and spaced apart, longitudinally extending U-shaped members with said upstanding end members, wherein said base assembly further includes lateral support means extending outwardly and perpendicularly of said pair of U-shaped members to stabilize said U-shaped member, each upstanding end member of said pair of U-shaped members having at least one opening therethrough in a horizontal plane in alignment with a similar opening in its opposing end member to receive a shaft; said hand gripping assembly comprising a pair of inverted L-shaped members, each member having a downwardly extending vertical leg pivotally mounted between said respective upstanding upstanding end member on said shaft extending through said at least one opening in each upstanding end member, said shaft being adapted for insertion into any other opening in each said upstanding end member of said base assembly, said other leg of said L-shaped member extending perpendicularly to said vertical end member and outwardly of each said upstanding legs of said U-shaped members whereby the weight of an user of said device will rotate said hand gripping assembly downwardly outside said base assembly about said shaft unless said user applies an upwardly and inwardly directed force.

2. The device according to claim 1, wherein said hand gripping assemblies are vertically adjustable within said upstanding end members.

3. The device according to claim 1, wherein said base assembly is adjustable laterally to accommodate the width of a user's body.

4. The device according to claim 1, further comprising an adjustable tensioning member connected to said vertical legs of said hand gripping assemblies below said pivotal mounting to selectively move said assemblies outwardly about their respective pivotal mountings.

5. The device according to claim 1, wherein each longitudinally extending member comprises a pair of horizontal elements, each of said elements terminating at one end in said upstanding end members, a sleeve encompassing each other end of said horizontal elements and means on said horizontal elements and said sleeves to secure said elements within said sleeves in predetermined lateral relationship.

6. An exercise device for the upper torso comprising a stabilized base assembly with separate upstanding end members and a hand gripping assembly pivotally mounted to each of said upstanding end members, said base assembly comprising a pair of parallel and spaced apart, longitudinally extending U-shaped members with said upstanding end members, wherein said base assembly further includes lateral support means extending outwardly and perpendicularly from each of said pair of U-shaped membes to stabilize said U-shaped member, each upstanding end member of said pair of U-shaped members having at least one opening therethrough in a horizontal plane in alignment with a similar opening in its opposing end member to receive a shaft; said hand gripping assembly comprising a vertical member pivotally mounted between respective said upstanding end members, said vertical member having at least one opening therethrough for attachment to said shaft and for vertical adjustment of said vertical member between said upstanding end members, a U-shaped bracket centrally affixed to said vertical member's upper end and a hand hold positioned between said U-shaped bracket's upper ends, whereby the weight of a user of said device will rotate said hand gripping assembly downwardly outside said base assembly about said shaft unless said user applies an upwardly and inwardly directed force.

7. An exercise device requiring the simultaneous exertion of horizontal and vertical forces by an exercisor to perform dips and pushups comprising a stabilized U-shaped base assembly of at least a pair of spaced apart, parallel, horizontally, extending members, a pair of spaced apart members extending upwardly from each end of said horizontally extending members, an inverted L-shaped member comprised of a horizontal element and a vertical element, positioned between each of said pair of said spaced apart upwardly extending members, said vertical element being pivotally mounted on a shaft extending between each of said upwardly extending members, said horizontal element extending outwardly of said vertical element and a horizontally positioned bracket element secured to each of said upwardly extending members interior side between said pivotal mounting of each said inverted L-shaped member and said spaced apart horizontally extending members of said base assembly for preventing excessive inward rotation of said L-shaped member.

8. A method for performing known exercises as push-ups and dips on a device comprising:

(1) a stabilized base with two opposing, parallel, horizontal shafts mounted thereon;

(2) two hand gripping assemblies, each comprising a horizontal gripping portion and a downward vertical extension having an opening therethrough, each handle gripping assembly being pivotally mounted on each said shaft with the said shaft through the said opening in the said vertical extension;

(3) and a bracket means fastened on each end of the said base to prevent the vertical extensions, above said opening of the hand gripping assemblies from rotating past the vertical toward each other; an exercisor performing the exercises by exerting inwardly directed horizontal forces to maintain each said horizontal portion of the hand gripping assemblies in a horizontal position and simultaneously raising and lowering said exercisor's body in vertical movement.

9. An exercise device for the upper torso comprising a stabilized base assembly with separate upstanding end members and a hand gripping assembly pivotally mounted to each of said upstanding end members, said base assembly comprising a pair of parallel and spaced apart, longitudinally extending U-shaped members with said upstanding end members, wherein said base assembly further includes lateral support means extending outwardly and perpendicularly from each of said pair of U-shaped members to stabilize said U-shaped member, each upstanding end member of said pair of U-shaped members having at least one opening therethrough in a horizontal plane in alignment with a similar opening in its opposing end member to receive a shaft; said hand gripping assembly comprising a vertical member pivotally mounted between respective said upstanding end members, said vertical member having at least one opening therethrough for attachment to said shaft and for vertical adjustment of said vertical member between said upstanding end members, each said vertical member upper end terminating in an arcuate segment attached at one end to, and extending above, said upper end, each said segment having a horizontal element secured to its other end and extending outwardly therefrom, said segment and horizontal element having a combined length such that a user's hands can be moved from a position in substantial alignment with said vertical member nominal vertical axis to a position outboard of said axis.

* * * * *

UNITED STATES PATENT AND TRADEMARK OFFICE

CERTIFICATE OF CORRECTION

PATENT NO. : 4,900,015

DATED : February 13, 1990

INVENTOR(S) : Thomas C. Dissinger

It is certified that error appears in the above-indentified patent and that said Letters Patent is hereby corrected as shown below:

In the Drawings:
Insert figures 13-28 as part of Letters Patent as shown on the attached sheets.

Signed and Sealed this

Fourth Day of October, 1994

*Attest:*

*Attesting Officer*

Bruce Lehman

BRUCE LEHMAN

*Commissioner of Patents and Trademarks*